US011069304B2

(12) United States Patent
Lee et al.

(10) Patent No.: US 11,069,304 B2
(45) Date of Patent: Jul. 20, 2021

(54) LIGHT SOURCE APPARATUS AND DISPLAY APPARATUS HAVING THE SAME

(71) Applicant: Samsung Display Co., Ltd., Yongin-si (KR)

(72) Inventors: Dae-Sik Lee, Hwaseong-si (KR); Yoongu Kim, Seoul (KR); Seung Young Choi, Yongin-si (KR); Keunoh Kang, Uijeongbu-si (KR); Kihyun Pyun, Gwangmyeong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/790,525

(22) Filed: Feb. 13, 2020

(65) Prior Publication Data

US 2020/0258455 A1 Aug. 13, 2020

(30) Foreign Application Priority Data

Feb. 13, 2019 (KR) ..... 10-2019-0016805

(51) Int. Cl.
*G09G 3/34* (2006.01)
*G09G 3/36* (2006.01)

(52) U.S. Cl.
CPC ..... *G09G 3/3406* (2013.01); *G09G 3/3674* (2013.01); *G09G 2310/0286* (2013.01); *G09G 2320/0252* (2013.01); *G09G 2320/0626* (2013.01); *G09G 2330/023* (2013.01)

(58) Field of Classification Search
CPC ..... G09G 3/34–3426
See application file for complete search history.

(56) References Cited

U.S. PATENT DOCUMENTS

2010/0315446 A1* 12/2010 An ..... G09G 3/3426 345/690
2011/0199011 A1* 8/2011 Nakazawa ..... G09G 3/342 315/193
2014/0306873 A1* 10/2014 Yamashita ..... G09G 3/3426 345/102
2015/0348479 A1* 12/2015 Kim ..... G09G 3/3611 345/204

* cited by examiner

*Primary Examiner* — Roy P Rabindranath
(74) *Attorney, Agent, or Firm* — Lewis Roca Rothgerber Christie LLP

(57) ABSTRACT

A light source apparatus includes a light source and a light source driver. The light source includes a plurality of scan blocks. Each scan block includes a plurality of local dimming blocks. The light source driver includes a plurality of channels configured to output light source driving signals to the plurality of local dimming blocks. The light source driving signal includes a light source intensity value representing a light intensity of a local dimming block from among the plurality of local dimming blocks and a delay value representing a degree of a delay of the local dimming block. The delay value is determined by a scan delay value varied according to the plurality of scan blocks and a delay parameter.

21 Claims, 12 Drawing Sheets

FIG. 2

100

| | | | | | | | |
|---|---|---|---|---|---|---|---|
| DB11 | DB12 | DB13 | DB14 | DB15 | DB16 | DB17 | DB18 |
| DB21 | DB22 | DB23 | DB24 | DB25 | DB26 | DB27 | DB28 |
| DB31 | DB32 | DB33 | DB34 | DB35 | DB36 | DB37 | DB38 |
| DB41 | DB42 | DB43 | DB44 | DB45 | DB46 | DB47 | DB48 |
| DB51 | DB52 | DB53 | DB54 | DB55 | DB56 | DB57 | DB58 |
| DB61 | DB62 | DB63 | DB64 | DB65 | DB66 | DB67 | DB68 |

FIG. 3

BLU

| | | | | | | | |
|---|---|---|---|---|---|---|---|
| LB11 | LB12 | LB13 | LB14 | LB15 | LB16 | LB17 | LB18 |
| LB21 | LB22 | LB23 | LB24 | LB25 | LB26 | LB27 | LB28 |
| LB31 | LB32 | LB33 | LB34 | LB35 | LB36 | LB37 | LB38 |
| LB41 | LB42 | LB43 | LB44 | LB45 | LB46 | LB47 | LB48 |
| LB51 | LB52 | LB53 | LB54 | LB55 | LB56 | LB57 | LB58 |
| LB61 | LB62 | LB63 | LB64 | LB65 | LB66 | LB67 | LB68 |

FIG. 5

| | | | | | | | | | | | | |
|---|---|---|---|---|---|---|---|---|---|---|---|---|
| SB1 | LB1 | LB2 | LB3 | LB4 | LB5 | LB6 | LB7 | LB8 | LB9 | LB10 | LB11 | LB12 |
| | LB13 | LB14 | LB15 | LB16 | LB17 | LB18 | LB19 | LB20 | LB21 | LB22 | LB23 | LB24 |
| SB2 | LB25 | LB26 | LB27 | LB28 | LB29 | LB30 | LB31 | LB32 | LB33 | LB34 | LB35 | LB36 |
| | LB37 | LB38 | LB39 | LB40 | LB41 | LB42 | LB43 | LB44 | LB45 | LB46 | LB47 | LB48 |
| SB3 | LB49 | LB50 | LB51 | LB52 | LB53 | LB54 | LB55 | LB56 | LB57 | LB58 | LB59 | LB60 |
| | LB61 | LB62 | LB63 | LB64 | LB65 | LB66 | LB67 | LB68 | LB69 | LB70 | LB71 | LB72 |
| SB4 | LB73 | LB74 | LB75 | LB76 | LB77 | LB78 | LB79 | LB80 | LB81 | LB82 | LB83 | LB84 |
| | LB85 | LB86 | LB87 | LB88 | LB89 | LB90 | LB91 | LB92 | LB93 | LB94 | LB95 | LB96 |
| SB5 | LB97 | LB98 | LB99 | LB100 | LB101 | LB102 | LB103 | LB104 | LB105 | LB106 | LB107 | LB108 |
| | LB109 | LB110 | LB111 | LB112 | LB113 | LB114 | LB115 | LB116 | LB117 | LB118 | LB119 | LB120 |
| SB6 | LB121 | LB122 | LB123 | LB124 | LB125 | LB126 | LB127 | LB128 | LB129 | LB130 | LB131 | LB132 |
| | LB133 | LB134 | LB135 | LB136 | LB137 | LB138 | LB139 | LB140 | LB141 | LB142 | LB143 | LB144 |

FIG. 7

| | | | | | | | | |
|---|---|---|---|---|---|---|---|---|
| HTCH1 | CH1 HT[7] | CH1 HT[6] | CH1 HT[5] | CH1 HT[4] | CH1 HT[3] | CH1 HT[2] | CH1 HT[1] | CH1 HT[0] |
| | 0 | 0 | 0 | 0 | CH1 HT[11] | CH1 HT[10] | CH1 HT[9] | CH1 HT[8] |
| HTCH2 | CH2 HT[7] | CH2 HT[6] | CH2 HT[5] | CH2 HT[4] | CH2 HT[3] | CH2 HT[2] | CH2 HT[1] | CH2 HT[0] |
| | 0 | 0 | 0 | 0 | CH2 HT[11] | CH2 HT[10] | CH2 HT[9] | CH2 HT[8] |

FIG. 8

| | | | | | | | | |
|---|---|---|---|---|---|---|---|---|
| DELCH1 | CH1 DEL[7] | CH1 DEL[6] | CH1 DEL[5] | CH1 DEL[4] | CH1 DEL[3] | CH1 DEL[2] | CH1 DEL[1] | CH1 DEL[0] |
| | 0 | 0 | 0 | 0 | CH1 DEL[11] | CH1 DEL[10] | CH1 DEL[9] | CH1 DEL[8] |
| DELCH2 | CH2 DEL[7] | CH2 DEL[6] | CH2 DEL[5] | CH2 DEL[4] | CH2 DEL[3] | CH2 DEL[2] | CH2 DEL[1] | CH2 DEL[0] |
| | 0 | 0 | 0 | 0 | CH2 DEL[11] | CH2 DEL[10] | CH2 DEL[9] | CH2 DEL[8] |

FIG. 9

| NO | REAL DELAY TIME[ms] |
|---|---|
| 1 | 0.26 |
| 2 | 0.52 |
| 3 | 0.78 |
| 4 | 1.04 |
| 5 | 1.30 |
| 6 | 1.56 |
| ⋮ | ⋮ |
| 32 | 8.33 |

FIG. 10

| HSYNC COUNT (max 2047) | DLYPAR (max 2047) | DELAY TIME (ms) | BLOCK NO. |
|---|---|---|---|
| 63.96875 | 340 | 1.384 | 1 |
| 127.9375 | | 2.768 | 2 |
| 191.90625 | | 4.152 | 3 |
| 255.875 | | 5.537 | 4 |
| 319.84375 | | 6.921 | 5 |
| 383.8125 | | 8.305 | 6 |

FIG. 11

| N0 | D7 | D6 | D5 | D4 | D3 | D2 | D1 | D0 |
|---|---|---|---|---|---|---|---|---|
| 1 | HT1[7] | HT1[6] | HT1[5] | HT1[4] | HT1[3] | HT1[2] | HT1[1] | HT1[0] |
| 2 | DEL1[4] | DEL1[3] | DEL1[2] | DEL1[1] | DEL1[0] | HT1[10] | HT1[9] | HT1[8] |
| ⋮ | ⋮ | ⋮ | ⋮ | ⋮ | ⋮ | ⋮ | ⋮ | ⋮ |
| 127 | HT64[7] | HT64[6] | HT64[5] | HT64[4] | HT64[3] | HT64[2] | HT64[1] | HT64[0] |
| 128 | DEL64[4] | DEL64[3] | DEL64[2] | DEL64[1] | DEL64[0] | HT64[10] | HT64[9] | HT64[8] |
| 129 | DLYPAR[7] | DLYPAR[6] | DLYPAR[5] | DLYPAR[4] | DLYPAR[3] | DLYPAR[2] | DLYPAR[1] | DLYPAR[0] |
| 130 | – | – | – | – | – | DLYPAR[10] | DLYPAR[9] | DLYPAR[8] |

FIG. 12

| N0 | D7 | D6 | D5 | D4 | D3 | D2 | D1 | D0 |
|---|---|---|---|---|---|---|---|---|
| 1 | HT1[7] | HT1[6] | HT1[5] | HT1[4] | HT1[3] | HT1[2] | HT1[1] | HT1[0] |
| 2 | DEL1[4] | DEL1[3] | DEL1[2] | DEL1[1] | DEL1[0] | HT1[10] | HT1[9] | HT1[8] |
| ⋮ | ⋮ | ⋮ | ⋮ | ⋮ | ⋮ | ⋮ | ⋮ | ⋮ |
| 287 | HT144[7] | HT144[6] | HT144[5] | HT144[4] | HT144[3] | HT144[2] | HT144[1] | HT144[0] |
| 288 | DEL144[4] | DEL144[3] | DEL144[2] | DEL144[1] | DEL144[0] | HT144[10] | HT144[9] | HT144[8] |
| 289 | DLYPAR[7] | DLYPAR[6] | DLYPAR[5] | DLYPAR[4] | DLYPAR[3] | DLYPAR[2] | DLYPAR[1] | DLYPAR[0] |
| 290 | - | - | - | - | - | DLYPAR[10] | DLYPAR[9] | DLYPAR[8] |

FIG. 13

| BLOCK QTY | DLYPAR | LAST BLOCK TIME[ms] | GAP[ms] |
|---|---|---|---|
| 1 | 2046 | 8.325 | 0.008 |
| 2 | 1024 | 8.333 | 0 |
| 3 | 682 | 8.325 | 0.008 |
| 4 | 512 | 8.333 | 0 |
| 5 | 408 | 8.3 | 0.033 |
| 6 | 340 | 8.3 | 0.033 |
| 7 | 292 | 8.317 | 0.016 |
| 8 | 256 | 8.333 | 0 |
| 9 | 226 | 8.276 | 0.057 |
| 10 | 204 | 8.3 | 0.033 |
| 11 | 186 | 8.325 | 0.008 |
| 12 | 170 | 8.3 | 0.033 |
| 13 | 156 | 8.25 | 0.083 |
| 14 | 146 | 8.317 | 0.016 |
| 15 | 136 | 8.3 | 0.033 |
| 16 | 128 | 8.333 | 0 |

LIGHT SOURCE APPARATUS AND DISPLAY APPARATUS HAVING THE SAME

CROSS-REFERENCE TO RELATED APPLICATION

This application claims priority to and the benefit of Korean Patent Application No. 10-2019-0016805, filed on Feb. 13, 2019 in the Korean Intellectual Property Office KIPO, the contents of which are herein incorporated by reference in their entireties.

BACKGROUND

1. Field

Exemplary embodiments of the present inventive concept relate to a light source apparatus and a display apparatus including the light source apparatus.

2. Description of the Related Art

In a local dimming method used by a display apparatus, a degree of turning on of a light source is determined based upon a corresponding luminance of a block of input image data to reduce a power consumption of a display apparatus.

In order to further reduce the power consumption of the display apparatus and/or to enhance a response time of a video image, the number of local dimming blocks may be increased. A light source driving signal to drive the local dimming blocks may have a light source intensity value and a delay value. When the number of the local dimming blocks is increased, a storage area of a register to store the light source intensity value and the delay value may be correspondingly increased.

SUMMARY

Exemplary embodiments of the present inventive concept relate to a light source apparatus capable of efficiently using a storage area of a register of a light source driver and a display apparatus including the light source apparatus.

Exemplary embodiments of the present inventive concept provide a light source apparatus having an efficient storage area of a register using a delay parameter commonly applied to a plurality of scan blocks in a local dimming method.

Exemplary embodiments of the present inventive concept also provide a display apparatus including the light source apparatus.

In an exemplary embodiment of a light source apparatus according to the present inventive concept, the light source apparatus includes a light source and a light source driver. The light source includes a plurality of scan blocks. Each scan block includes a plurality of local dimming blocks. The light source driver includes a plurality of channels configured to output light source driving signals to the plurality of local dimming blocks. Each light source driving signal includes a light source intensity value representing a light intensity of a local dimming block from among the plurality of local dimming blocks and a delay value representing a degree of a delay of the local dimming block. The delay value is determined by a scan delay value varied according to the plurality of scan blocks and a delay parameter.

In an exemplary embodiment, the delay parameter may correspond to a count value of a horizontal synchronizing signal of a light source driving signal from among the light source driving signals and a number of the plurality of scan blocks of the light source.

In an exemplary embodiment, the count value of the horizontal synchronizing signal of the light source driving signal may represent a resolution of the light source intensity value.

In an exemplary embodiment, the delay parameter comprises an integer close to the count value of the horizontal synchronizing signal divided by the number of the plurality of scan blocks.

In an exemplary embodiment, the light source intensity value, the scan delay value and the delay parameter may be stored in a register of the light source driver.

In an exemplary embodiment, when a number of the channels of the light source driver is N, a size of the register of the light source driver may be 2N+2 bytes.

In an exemplary embodiment, the light source intensity value of each of the channels and the scan delay value of each of the channels may be stored in a first storage area of two bytes in the register. The delay parameter may be stored in a second storage area of two bytes in the register.

In an exemplary embodiment, the light source intensity value of each of the channels may be stored in 11 bits in the first storage area. The scan delay value of each of the channels may be stored in 5 bits in the first storage area.

In an exemplary embodiment, the delay value of the light source driving signal may correspond to a distance between a falling edge of the light source driving signal applied to a first scan block from among the scan blocks and a falling edge of the light source driving signal applied to a present scan block from among the scan blocks. The light source intensity value of the light source driving signal may correspond to a distance between a rising edge of the light source driving signal and a falling edge of the light source driving signal.

In an exemplary embodiment, the delay value of the light source driving signal may correspond to a distance between a rising edge of the light source driving signal applied to a first scan block from among the scan blocks and a rising edge of the light source driving signal applied to a present scan block from among the scan blocks. The light source intensity value of the light source driving signal may correspond to a distance between a rising edge of the light source driving signal and a falling edge of the light source driving signal.

In an exemplary embodiment, the light source may include a first scan block from among the scan blocks and a second scan block from among the scan blocks. The first scan block may include local dimming blocks in a first row and local dimming blocks in a second row. The second scan block may include local dimming blocks in a third row and local dimming blocks in a fourth row.

In an exemplary embodiment, the delay parameter is not varied according to the plurality of scan blocks.

In an exemplary embodiment of a display apparatus according to the present inventive concept, the display apparatus includes a display panel, a display panel driver, a light source and a light source driver. The display panel is configured to display an image based on input image data. The display panel driver is configured to drive the display panel and to generate a dimming signal representing a degree of dimming of each of local dimming blocks based on the input image data. The light source is configured to provide a light to the display panel. The light source includes a plurality of scan blocks. Each scan block includes a plurality of the local dimming blocks. The light source driver includes a plurality of channels configured to output light source driving signals to the plurality of local dimming blocks based on the dimming signal. The light source driving signal may include a light source intensity value representing a light intensity of a local dimming block from among the plurality of local dimming blocks and a delay value representing a degree of a delay of the local dimming block. The delay value is determined by a scan delay value varied according to the plurality of scan blocks and a delay parameter.

In an exemplary embodiment, the display panel may include a plurality of display blocks, the plurality of display blocks corresponding to the plurality of local dimming blocks.

In an exemplary embodiment, the plurality of display blocks may correspond to the local dimming blocks one-to-one.

In an exemplary embodiment, the delay parameter corresponds to a count value of a horizontal synchronizing signal of the light source driving signal and a number of the plurality of scan blocks of the light source.

In an exemplary embodiment, the count value of the horizontal synchronizing signal of the light source driving signal may represent a resolution of the light source intensity value.

In an exemplary embodiment, the delay parameter comprises an integer close to the count value of the horizontal synchronizing signal divided by the number of the plurality of scan blocks.

In an exemplary embodiment, the light source intensity value, the scan delay value and the delay parameter may be stored in a register of the light source driver.

In an exemplary embodiment, when a number of the channels of the light source driver is N, a size of the register of the light source driver may be 2N+2 bytes.

According to the light source apparatus and the display apparatus, the delay value of the light source driving signal applied to the light source may be determined by the scan delay value varied according to the scan blocks and the delay parameter not varied according to the scan blocks. Thus, the storage area of the register of the light source driver may be efficient in the local dimming method.

Accordingly, the number of the channels of the light source driver may be increased in the local dimming method so that the power consumption of the display apparatus may be reduced and/or the response time of the video image of the display panel may be enhanced.

BRIEF DESCRIPTION OF THE DRAWINGS

The above and other features and aspects of the present inventive concept will become more apparent by describing in detailed exemplary embodiments thereof with reference to the accompanying drawings, in which:

FIG. 2 is a conceptual diagram illustrating display blocks of the display panel of FIG. 1;

FIG. 3 is a conceptual diagram illustrating local dimming blocks of the light source of FIG. 1;

FIG. 5 is a conceptual diagram illustrating scan blocks and the local dimming blocks of the light source of FIG. 1;

FIGS. 7 and 8 are conceptual diagrams illustrating a register of the light source driver according to a comparative embodiment;

FIG. 9 is a table illustrating a delay value of the light source driving signal of FIG. 6;

FIG. 10 is a conceptual diagram illustrating a count value of a horizontal synchronizing signal, a delay parameter, a delay time and a scan block number of the light source driving signal of FIG. 6;

FIG. 11 is a conceptual diagram illustrating an example of a register of the light source driver of FIG. 1;

FIG. 12 is a conceptual diagram illustrating an example of a register of the light source driver of FIG. 1;

FIG. 13 is a table illustrating a delay parameter according to the number of the scan blocks of the light source of FIG. 1.

DETAILED DESCRIPTION

Figure 1:
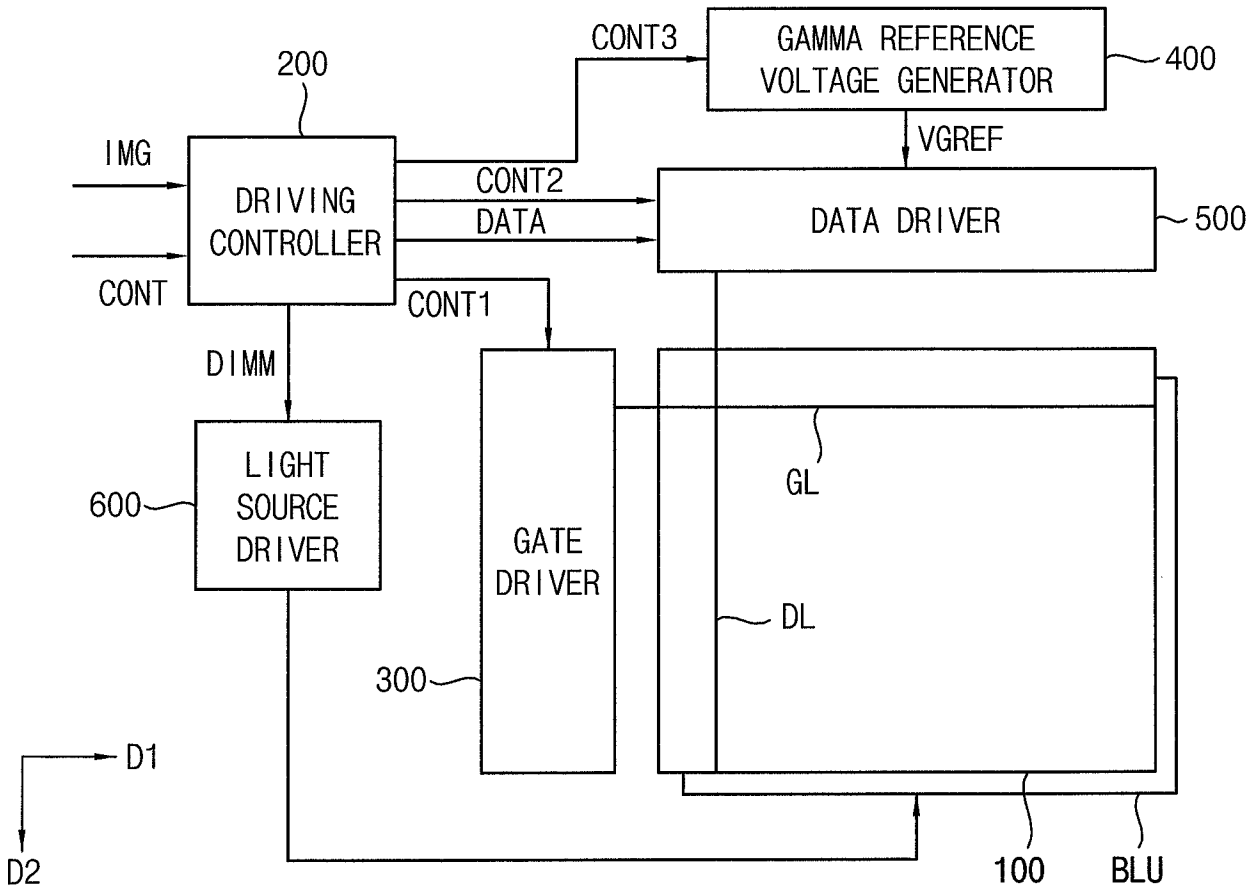
FIG. 1 is a block diagram illustrating a display apparatus according to an exemplary embodiment of the present inventive concept.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention."

As used herein, the terms "use," "using," and "used" may be considered synonymous with the terms "utilize," "utilizing," and "utilized," respectively. Also, the term "exemplary" is intended to refer to an example or illustration.

The display apparatus and/or any other relevant devices or components according to embodiments of the present invention described herein may be implemented utilizing any suitable hardware, firmware (e.g., an application-specific integrated circuit), software, or a combination of software, firmware, and hardware. For example, the display apparatus may include a display panel, a display panel driver, a light source for providing light to the display panel, and a light source driver. The display panel driver may include a driving controller, a gate driver, a gamma reference voltage generator, and a data driver. The various components of the display apparatus may be formed on one integrated circuit (IC) chip or on separate IC chips. Further, the various components of these devices may be implemented on a flexible printed circuit film, a tape carrier package (TCP), a printed circuit board (PCB), or formed on one substrate. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500. The display apparatus may further include a light source BLU for providing light to the display panel 100 and a light source driver 600 for driving the light source BLU. The display apparatus may further include a host that provides input image data to the driving controller 200.

The display panel 100 includes a plurality of gate lines GL, a plurality of data lines DL, and a plurality of pixels electrically connected to the gate lines GL and the data lines DL. The gate lines GL may extend in a first direction D1 and the data lines DL may extend in a second direction D2 crossing the first direction D1.

The display panel 100 may be a liquid crystal display panel. The display panel 100 may include a first base substrate including the gate lines GL, the data lines DL, the pixels and the switching element, a second base substrate facing the first base substrate and including a common electrode, and a liquid crystal layer disposed between the first base substrate and the second base substrate.

The driving controller 200 may receive the input image data IMG and an input control signal CONT from the host. For example, the input image data IMG may include red image data, green image data, and blue image data. In some embodiments, the input image data IMG may include white image data. In some embodiments, the input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates a dimming signal DIMM to control a dimming operation of the light source BLU based on the input image data IMG. The driving controller 200 outputs the dimming signal DIMM to the light source driver 600.

The dimming signal DIMM may be a local dimming signal representing a degree of dimming of each of the local dimming blocks of the light source BLU.

The gate driver 300 generates gate signals for driving the gate lines GL in response to the first control signal CONT1 received from the driving controller 200. The gate driver 300 may output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The light source driver 600 may receive the dimming signal DIMM from the driving controller 200. The light source driver 600 may convert the dimming signal DIMM into a light source driving signal. The light source driver 600 may output the light source driving signal to the light source BLU.

FIG. 2 is a conceptual diagram illustrating display blocks of the display panel 100 of FIG. 1. FIG. 3 is a conceptual diagram illustrating local dimming blocks of the light source BLU of FIG. 1.

Referring to FIGS. 1-3, the display panel 100 may include a plurality of display blocks DB11 to DB68 for a local dimming operation. Although the display blocks DB11 to DB68 form a six-by-eight matrix in the present exemplary embodiment, the present inventive concept is not limited thereto and any suitably sized matrix of display blocks may be used.

In addition, the light source BLU may include a plurality of local dimming blocks LB11 to LB68 for the local dimming operation. Although the local dimming blocks LB11 to LB68 form a six-by-eight matrix in the present exemplary embodiment, the present inventive concept is not limited thereto and any suitably sized matrix of local dimming blocks may be used. In addition, the display blocks DB11-DB68 and the local dimming blocks LB11-LB68 may correspond to each other one-to-one in the present exemplary embodiment. Alternatively, a plurality of local dimming blocks may correspond to a single display block or a plurality of display blocks may correspond to the single local dimming block.

In the local dimming method, when the grayscale data of the image displayed on the display block is high (i.e., corresponding to a bright image), the degree of dimming of the local dimming block corresponding to the display block may be increased (i.e., the light output may be increased). On the other hand, when the grayscale data of the image displayed on the display block is low (i.e., corresponding to a dim image), the degree of dimming of the local dimming block corresponding to the display block may be decreased (i.e., the light output may be decreased).

Figure 4:
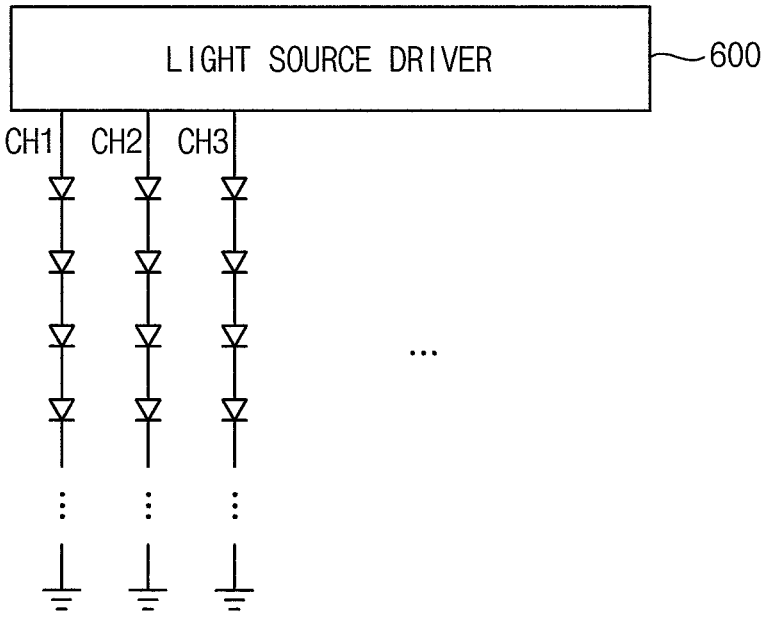
FIG. 4 is a conceptual diagram illustrating the light source driver of FIG. 1 and the local dimming blocks.

FIG. 4 is a conceptual diagram illustrating the light source driver 600 of FIG. 1 and the local dimming blocks. FIG. 5 is a conceptual diagram illustrating scan blocks and the local dimming blocks of the light source BLU of FIG. 1.

Referring to FIGS. 1-5, the light source BLU may include a plurality of scan blocks (e.g., SB1 to SB6 in FIG. 5). The scan blocks SB1 to SB6 may include a plurality of local dimming blocks (e.g., LB1 to LB144 in FIG. 5). For example, a first scan block SB1 may include local dimming blocks LB1 to LB12 in a first row and local dimming blocks LB13 to LB24 in a second row. For example, a second scan block SB2 may include local dimming blocks LB25 to LB36 in a third row and local dimming blocks LB37 to LB48 in a fourth row. For example, a third scan block SB3 may include local dimming blocks LB49 to LB60 in a fifth row and local dimming blocks LB61 to LB72 in a sixth row. For example, a fourth scan block SB4 may include local dimming blocks LB73 to LB84 in a seventh row and local dimming blocks LB85 to LB96 in an eighth row. For example, a fifth scan block SB5 may include local dimming blocks LB97 to LB108 in a ninth row and local dimming blocks LB109 to LB120 in a tenth row. For example, a sixth scan block SB6 may include local dimming blocks LB121 to LB132 in an eleventh row and local dimming blocks LB133 to LB144 in a twelfth row.

Although the scan block includes local dimming blocks disposed in two adjacent rows, the present inventive concept is not limited thereto. Alternatively, the scan block may include local dimming blocks disposed in a single row. Alternatively, the scan block may include local dimming blocks disposed in three or more rows.

The light source driver 600 may include a plurality of channels CH1 to CH144 for outputting the light source driving signals to the local dimming blocks LB1 to LB144. The number of the channels may be equal to the number of the local dimming blocks. Although a plurality of light emitting elements of the local dimming blocks are disposed along a vertical direction for convenience of explanation in FIG. 4, the local dimming blocks may be disposed in the light source BLU as shown in FIG. 5.

Figure 6:
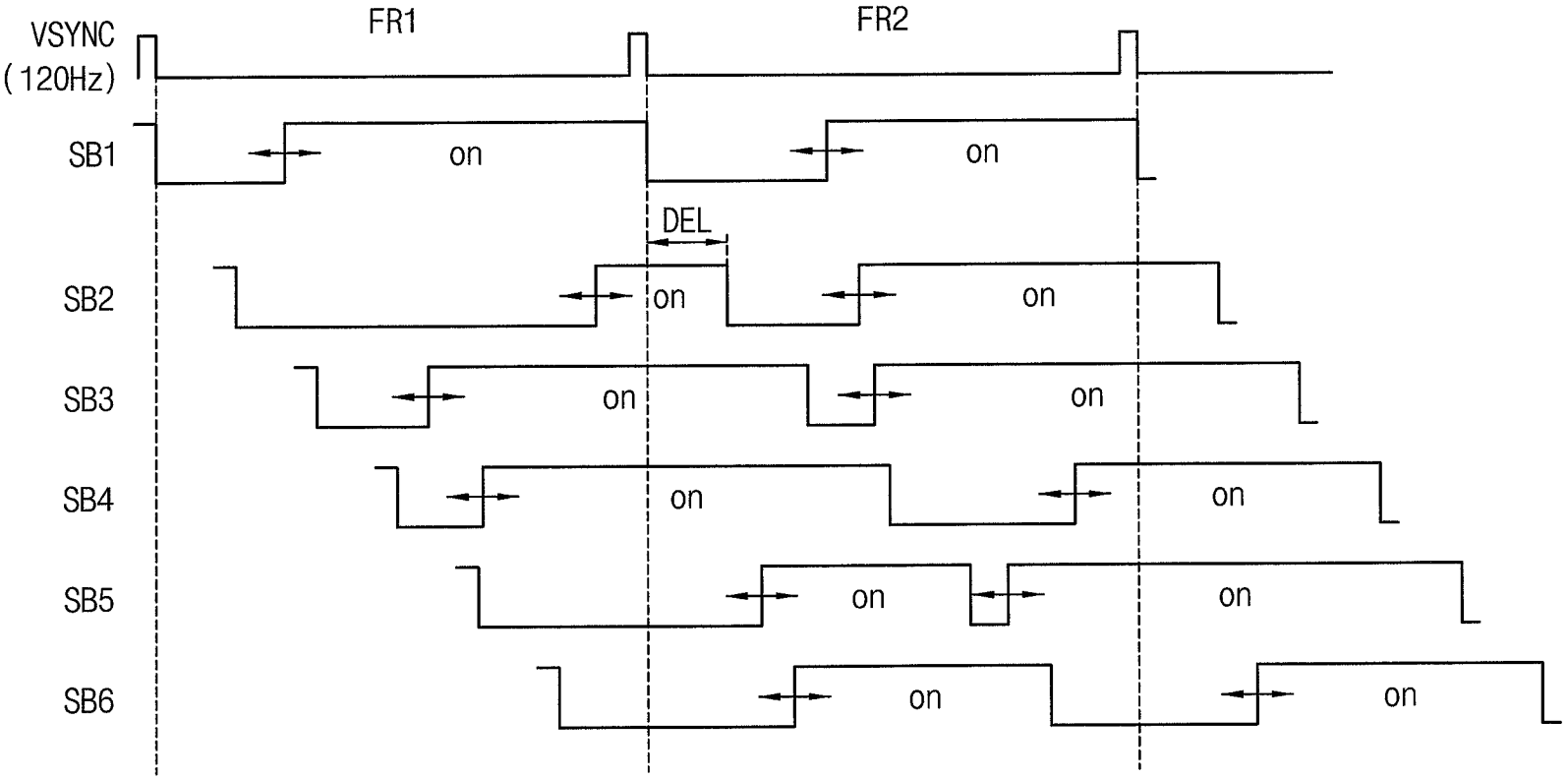
FIG. 6 is a timing diagram illustrating a light source driving signal of the light source of FIG. 1.

FIG. 6 is a timing diagram illustrating the light source driving signal of the light source BLU of FIG. 1.

Referring to FIGS. 1-6, the light source driving signal may include a light source intensity value representing a light intensity of the local dimming block and a delay value representing a degree of a delay of the local dimming block.

The local dimming blocks in the same scan block may have the same delay value. The local dimming blocks in the same scan block may have light source intensity values varied according to the image of the display blocks corresponding to the local dimming blocks.

In FIG. 6, SB1 represents a light source driving signal applied to one of the local dimming blocks in the first scan block (e.g., SB1 in FIG. 5), SB2 represents a light source driving signal applied to one of the local dimming blocks in the second scan block (e.g., SB2 in FIG. 5), SB3 represents a light source driving signal applied to one of the local dimming blocks in the third scan block (e.g., SB3 in FIG. 5), SB4 represents a light source driving signal applied to one of the local dimming blocks in the fourth scan block (e.g., SB4 in FIG. 5), SB5 represents a light source driving signal applied to one of the local dimming blocks in the fifth scan block (e.g., SB5 in FIG. 5) and SB6 represents a light source driving signal applied to one of the local dimming blocks in the sixth scan block (e.g., SB6 in FIG. 5).

In the present exemplary embodiment, the delay value DEL of the light source driving signal may correspond to a distance between a falling edge of the light source driving signal applied to the first scan block SB1 and a falling edge of the light source driving signal applied to a present scan block (e.g., SB2, SB3, SB4, SB5 and SB6). The light source intensity value of the light source driving signal may correspond to a distance between a rising edge of the light source driving signal and a falling edge of the light source driving signal. For example, the light source intensity value may be a duty ratio of a pulse width modulation signal.

FIGS. 7 and 8 are conceptual diagrams illustrating a register of a light source driver according to a comparative embodiment.

In the comparative embodiment of FIGS. 7 and 8, the light source intensity value and the delay parameter may be stored in the register of the light source driver. In the comparative embodiment of FIGS. 7 and 8, a storage area of two bytes may be allocated for the light source intensity value corresponding to the single channel (or to the single local dimming block). For example, a light source intensity value HTCH1 of a first channel CH1 may be stored in the storage area of two bytes. For example, the light source intensity value HTCH1 of the first channel CH1 may be stored in 11 bits of the storage area. For example, a light source intensity value HTCH2 of a second channel CH2 may be stored in the storage area of two bytes. For example, the light source intensity value HTCH2 of the second channel CH2 may be stored in 11 bits of the storage area.

In the comparative embodiment of FIGS. 7 and 8, a storage area of two bytes may be allocated for the delay value corresponding to the single channel (or to the single local dimming block). For example, a delay value DELCH1 of the first channel CH1 may be stored in the storage area of two bytes. For example, the delay value DELCH1 of the first channel CH1 may be stored in 11 bits of the storage area. For example, a delay value DELCH2 of the second channel CH2 may be stored in the storage area of two bytes. For example, the delay value DELCH2 of the second channel CH2 may be stored in 11 bits of the storage area.

In this embodiment, the light source intensity value has 11 bits, thus the light source intensity value may be a value of 0 to 2047. When a frequency of a vertical synchronizing signal VSYNC is 120 Hz, a length of a frame FR1 and FR2 is about 8.33 ms. 8.33 ms may be divided by 2047 (or 2048) to arrive at 4.07 us. Thus, the light source intensity value (e.g., the duty ratio) may be adjusted in a unit time of 4.07 us.

When the light source intensity value has 11 bits, a count value HCOUNT of a horizontal synchronizing signal HSYNC is 2047. The count value HCOUNT of the horizontal synchronizing signal HSYNC may represent a resolution of the light source intensity value. When the frequency of the vertical synchronizing signal VSYNC is 120 Hz and the count value HCOUNT of the horizontal synchronizing signal HSYNC is 2047, the resolution of the light source intensity value may be 4.07 us.

In the comparative embodiment of FIGS. 7 and 8, the light source intensity value uses the storage area of two bytes and the delay value uses the storage area of two bytes for each channel. Thus, when the number of the channels is N, the size of the register for storing the light source intensity value and the delay value may be 4N bytes.

FIG. 9 is a table illustrating the delay value of the light source driving signal of FIG. 6. FIG. 10 is a conceptual diagram illustrating a count value of a horizontal synchronizing signal, a delay parameter, a delay time and a scan block number of the light source driving signal of FIG. 6. FIG. 11 is a conceptual diagram illustrating an example of a register of the light source driver 600 of FIG. 1. FIG. 12 is a conceptual diagram illustrating an example of a register of the light source driver 600 of FIG. 1.

Referring to FIGS. 1-12, the light source driving signal may include the light source intensity value representing the light intensity of the local dimming block and the delay value representing the degree of the delay of the local dimming block. The delay value may be determined by a scan delay value which is varied according to the scan block and a delay parameter DLYPAR which is not varied according to the scan block.

The delay parameter DLYPAR may be determined by the count value HCOUNT of the horizontal synchronizing signal HSYNC of the light source driving signal and the number of the scan blocks of the light source BLU.

The light source intensity value HT, the scan delay value DEL and the delay parameter DLYPAR may be stored in the register of the light source driver 600.

The light source intensity value HT and the scan delay value DEL may be stored in a storage area of two bytes for each channel. In addition, the delay parameter DLYPAR which is commonly applied to all of the channels may be stored in a storage area of two bytes.

The light source intensity value HT of the channel may be stored in 11 bits of the storage area and the scan delay value DEL of the channel may be stored in 5 bits of the storage area. FIG. 9 represents delay times determined by 32 scan delay values of 5 bits. When the frequency of the vertical synchronizing signal VSYNC is 120 Hz, a resolution of the delay time is about 0.26 ms which is obtained by dividing 8.33 ms by 32 (i.e., divided by the number of scan delay values).

In FIG. 6, a desirable delay time for six scan blocks may be about 1.38 ms which is obtained by dividing 8.33 ms by 6 (i.e., divided by the number of scan blocks). However, the resolution of the delay time determined by the scan delay value may be 0.26 ms so that a practical delay time may be one of 1.30 ms (0.26 ms*5) or 1.56 ms (0.26 ms*6).

In the present exemplary embodiment, the delay parameter DLYPAR which is commonly applied to all of the scan blocks may be stored to compensate for the difference of the desirable delay time and the practical delay time. The delay parameter DLYPAR may be determined by the count value (e.g., 2047) of the horizontal synchronizing signal HSYNC of the light source driving signal and the number of the scan blocks (e.g., 6) of the light source BLU.

When the delay parameter is "DLYPAR", the count value of the horizontal synchronizing signal HSYNC is "HCOUNT" and the number of the scan blocks is "BLOCK QTY", DLYPAR may be determined as one of integers close (e.g., the closest) to HCOUNT divided by BLOCK QTY, i.e., $$\frac{HCOUNT}{\text{BLOCK } QTY}.$$

When the count value of the horizontal synchronizing signal HSYNC is 2047 and the number of the scan blocks is 6, 2047 divided by 6 is about 341.167. Thus, the delay parameter DLYPAR may be determined as 341 which is the closest integer to 341.167. For convenience of description and calculation, the delay parameter DLYPAR is represented as 340 in FIG. 10.

When the delay parameter DLYPAR is 340, the delay time of the channels in the first scan block SB1 is determined to be about 1.384 ms by following Equation 1.

$$\frac{PWMTIME}{HSYNC} * DLYPAR * BLOCKNO = \frac{8.33}{2047} * 340 * 1 = 1.384 \quad \text{Equation 1}$$

In the same way, the delay time of the channels in the second scan block SB2 may be determined to be about 2.768 ms. In the same way, the delay time of the channels in the third scan block SB3 may be determined to be about 4.152 ms. In the same way, the delay time of the channels in the fourth scan block SB4 may be determined to be about 5.537 ms. In the same way, the delay time of the channels in the fifth scan block SB5 may be determined to be about 6.921 ms. In the same way, the delay time of the channels in the sixth scan block SB6 may be determined to be about 8.305 ms.

The delay time 8.305 ms of the sixth scan block SB6 is relatively close to 8.33 ms which is an inverse number of the frequency 120 Hz, thus the first to sixth scan blocks SB1 to SB6 may be driven in proper delay times.

In the present exemplary embodiment, the delay times of the first to sixth scan blocks SB1 to SB6 are respectively represented as 1.384 ms, 2.768 ms, 4.152 ms, 5.537 ms, 6.921 ms and 8.304 ms with respect to a sixth scan block SB6 of a previous frame. Alternatively, the delay times of the first to sixth scan blocks SB1 to SB6 may be respectively represented as 0, 1.384 ms, 2.768 ms, 4.152 ms, 5.537 ms and 6.921 ms with respect to the first scan block SB1 of a present frame.

In the present exemplary embodiment, when the number of the channels of the light source driver 600 is N, the size of the register of the light source driver 600 may be 2N+2 bytes.

As shown in FIG. 11, the light source intensity value HT1 to HT64 and the scan delay value DEL1 to DEL64 are stored in the storage area of two bytes. Thus, the light source intensity value HT1 to HT64 and the scan delay value DEL1 to DEL64 are stored in the storage area of 2N bytes for N channels. The single delay parameter DLYPAR is commonly applied to all of the channels so that the delay parameter DLYPAR is stored in the storage area of two bytes regardless of the number of the channels.

In FIG. 11, the number of the channels is 64 so that the size of the register may be 130 (i.e., 64*2+2) bytes. In the comparative embodiment, the register includes the storage area of 4N bytes so that the size of the register may be 256(i.e., 64*4) when the number of the channels is 64.

In FIG. 12, the number of the channels is 144 so that the size of the register may be 290 (i.e., 144*2+2) bytes. In the comparative embodiment, the register includes the storage area of 4N bytes so that the size of the register may be 576(i.e., 144*4) when the number of the channels is 144.

FIG. 13 is a table illustrating a delay parameter according to the number of the scan blocks of the light source BLU of FIG. 1.

Referring to FIGS. 1-13, when the delay parameter is "DLYPAR", the count value of the horizontal synchronizing signal HSYNC is "HCOUNT" and the number of the scan blocks is "BLOCK QTY", DLYPAR may be determined as one of integers close (e.g., the closest) to HCOUNT divided by BLOCK QTY, i.e., $$\frac{HCOUNT}{\text{BLOCK } QTY}$$

When the count value of the horizontal synchronizing signal HSYNC is 2047 and the number of the scan blocks is 6, 2047 divided by 6 is about 341.167. Thus, the delay parameter DLYPAR may be determined as 341 which is the closest integer to 341.167. For convenience of description and calculation, the delay parameter DLYPAR is represented as 340 in FIG. 10.

For example the delay parameter DLYPAR may be stored in the storage area of two bytes. For example the delay parameter DLYPAR may be stored in the storage area of 11 bits.

For example, when the number of the scan block is one, the delay parameter DLYPAR may be determined to be 2047 or 2046. For example, when the number of the scan blocks is two, the delay parameter DLYPAR may be determined to be 1024 or 1023. For example, when the number of the scan blocks is three, the delay parameter DLYPAR may be determined to be 682. For example, when the number of the scan blocks is four, the delay parameter DLYPAR may be determined to be 512. For example, when the number of the scan blocks is five, the delay parameter DLYPAR may be determined to be 409 or 408. For example, when the number of the scan blocks is six, the delay parameter DLYPAR may be determined to be 340 or 341.

As explained above, the delay values are applied to the scan blocks so that the delay time LAST BLOCK TIME of the last scan block may be close to 8.33 ms. A difference between the delay time LAST BLOCK TIME of the last scan block and 8.33 ms which is an inverse number of the frequency 120 Hz is represented as GAP[ms] in FIG. 13. GAPs [ms] in the various numbers BLOCK QTY of the scan blocks in FIG. 13 are generally less than 0.1 ms.

According to the present exemplary embodiment, the delay value of the light source driving signal applied to the light source may be determined by the scan delay value DEL (e.g., 5 bits) varied according to the scan blocks and the delay parameter DLYPAR (e.g., 11 bits), which is not varied according to the scan blocks. Thus, the storage area of the register of the light source driver 600 may be relatively more efficient in the local dimming method.

Accordingly, the number of the channels of the light source driver 600 may be increased in the local dimming method so that the power consumption of the display apparatus may be reduced and the response time of the video image of the display panel 100 may be enhanced.

Figure 14:
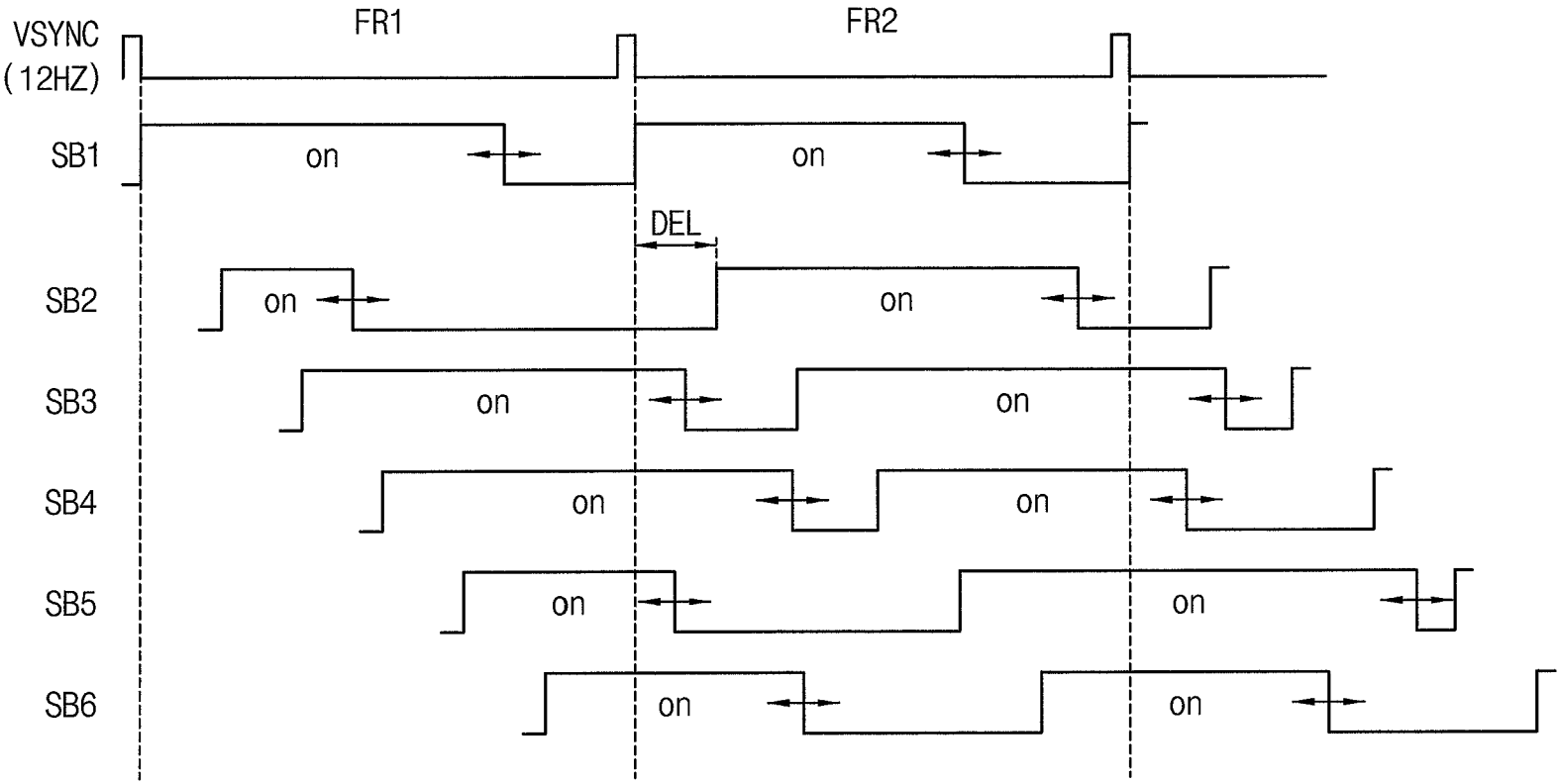
FIG. 14 is a timing diagram illustrating a light source driving signal of a light source of a display apparatus according to an exemplary embodiment of the present inventive concept.

FIG. 14 is a timing diagram illustrating a light source driving signal of a light source of a display apparatus according to an exemplary embodiment of the present inventive concept.

The light source apparatus and the display apparatus according to the present exemplary embodiment is substantially the same as the light source apparatus and the display apparatus of the previous exemplary embodiment explained referring to FIGS. 1-13 except for the waveform of the light source driving signal. Thus, the same reference numerals will be used to refer to the same or like parts as those described in the previous exemplary embodiment of FIGS. 1 to 13 and any repetitive explanation concerning the above elements may be omitted.

Referring to FIGS. 1-5 and 9-14, the display apparatus includes a display panel 100 and a display panel driver. The display panel driver includes a driving controller 200, a gate driver 300, a gamma reference voltage generator 400 and a data driver 500. The display apparatus may further include a light source BLU for providing light to the display panel 100 and a light source driver 600 for driving the light source BLU. The display apparatus may further include a host for providing input image data to the driving controller 200.

The light source BLU may include a plurality of scan blocks (e.g., SB1 to SB6 in FIG. 5). The scan blocks SB1 to SB6 may include a plurality of local dimming blocks (e.g., LB1 to LB144 in FIG. 5).

The light source driving signal may include a light source intensity value representing a light intensity of the local dimming block and a delay value representing a delay of the local dimming block.

The local dimming blocks in the same scan block may have the same delay value. The local dimming blocks in the same scan block may have light source intensity values varied according to the image of the display blocks corresponding to the local dimming blocks.

In FIG. 14, SB1 represents a light source driving signal applied to one of the local dimming blocks in the first scan block (SB1 in FIG. 5), SB2 represents a light source driving signal applied to one of the local dimming blocks in the second scan block (SB2 in FIG. 5), SB3 represents a light source driving signal applied to one of the local dimming blocks in the third scan block (SB3 in FIG. 5), SB4 represents a light source driving signal applied to one of the local dimming blocks in the fourth scan block (SB4 in FIG. 5), SB5 represents a light source driving signal applied to one of the local dimming blocks in the fifth scan block (SB5 in FIG. 5) and SB6 represents a light source driving signal applied to one of the local dimming blocks in the sixth scan block (SB6 in FIG. 5).

In the present exemplary embodiment, the delay value DEL of the light source driving signal may correspond to a distance between a rising edge of the light source driving signal applied to the first scan block SB1 and a rising edge of the light source driving signal applied to a present scan block (e.g., SB2, SB3, SB4, SB5 and SB6). The light source intensity value of the light source driving signal may correspond to a distance between a rising edge of the light source driving signal and a falling edge of the light source driving signal. For example, the light source intensity value may be a duty ratio of a pulse width modulation signal.

In the present exemplary embodiment, when the number of the channels of the light source driver 600 is N, the size of the register of the light source driver 600 may be 2N+2 bytes.

According to the present exemplary embodiment, the delay value of the light source driving signal applied to the light source may be determined by the scan delay value DEL (e.g., 5 bits) varied according to the scan blocks and the delay parameter DLYPAR (e.g., 11 bits) which is not varied according to the scan blocks. Thus, the storage area of the register of the light source driver 600 may be relatively efficient in the local dimming method.

Accordingly, the number of the channels of the light source driver 600 may be increased in the local dimming method so that the power consumption of the display apparatus may be reduced and the response time of the video image of the display panel 100 may be enhanced.

According to the present inventive concept as explained above, the size of the register of the light source driver may be reduced, the power consumption of the display apparatus may be reduced and/or the response time of the video image of the display panel may be enhanced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and aspects of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A light source apparatus comprising:

a light source comprising a plurality of scan blocks, each scan block comprising a plurality of local dimming blocks; and a light source driver comprising a plurality of channels configured to output light source driving signals to the local dimming blocks, wherein each light source driving signal comprises a light source intensity value representing a light intensity of a local dimming block from among the plurality of local dimming blocks and a delay value representing a degree of a delay of the local dimming block, wherein the delay value is determined by a scan delay value varied according to the plurality of scan blocks and a delay parameter, and wherein the delay value of the light source driving signal corresponds to a distance between a falling edge of the light source driving signal applied to a first scan block and a falling edge of the light source driving signal applied to a present scan block.

2. The light source apparatus of claim 1, wherein the delay parameter corresponds to a count value of a horizontal synchronizing signal of a light source driving signal from among the light source driving signals and a number of the plurality of scan blocks of the light source.

3. The light source apparatus of claim 2, wherein the count value of the horizontal synchronizing signal of the light source driving signal represents a resolution of the light source intensity value.

4. The light source apparatus of claim 3, wherein the delay parameter comprises an integer close to the count value of the horizontal synchronizing signal divided by the number of the plurality of scan blocks.

5. The light source apparatus of claim 1, wherein the light source intensity value, the scan delay value and the delay parameter are stored in a register of the light source driver.

6. The light source apparatus of claim 5, wherein when a number of the channels of the light source driver is N, a size of the register of the light source driver is 2N+2 bytes.

7. The light source apparatus of claim 6, wherein the light source intensity value of each of the channels and the scan delay value of each of the channels are stored in a first storage area of two bytes in the register, and wherein the delay parameter is stored in a second storage area of two bytes in the register.

8. The light source apparatus of claim 7, wherein the light source intensity value of each of the channels is stored in 11 bits in the first storage area, and wherein the scan delay value of each of the channels is stored in 5 bits in the first storage area.

9. The light source apparatus of claim 1, wherein the light source intensity value of the light source driving signal corresponds to a distance between a rising edge of the light source driving signal and a falling edge of the light source driving signal.

10. The light source apparatus of claim 1, wherein the delay parameter is not varied according to the plurality of scan blocks.

11. A light source apparatus comprising:

a light source comprising a plurality of scan blocks, each scan block comprising a plurality of local dimming blocks; and a light source driver comprising a plurality of channels configured to output light source driving signals to the local dimming blocks, wherein each light source driving signal comprises a light source intensity value representing a light intensity of a local dimming block from among the plurality of local dimming blocks and a delay value representing a degree of a delay of the local dimming block, wherein the delay value is determined by a scan delay value varied according to the plurality of scan blocks and a delay parameter, wherein the delay value of the light source driving signal corresponds to a distance between a rising edge of the light source driving signal applied to a first scan block from among the plurality of scan blocks and a rising edge of the light source driving signal applied to a present scan block from among the plurality of scan blocks, and wherein the light source intensity value of the light source driving signal corresponds to a distance between a rising edge of the light source driving signal and a falling edge of the light source driving signal.

12. The light source apparatus of claim 1, wherein the plurality of scan blocks comprises a first scan block and a second scan block, wherein the first scan block comprises local dimming blocks in a first row from among the plurality of local dimming blocks and local dimming blocks in a second row from among the plurality of local dimming blocks, and wherein the second scan block comprises local dimming blocks in a third row from among the plurality of local dimming blocks and local dimming blocks in a fourth row from among the plurality of local dimming blocks.

13. A display apparatus comprising:

a display panel configured to display an image based on input image data;

a display panel driver configured to drive the display panel and to generate a dimming signal representing a degree of dimming of each of local dimming blocks based on the input image data;

a light source configured to provide a light to the display panel and comprising a plurality of scan blocks, each scan block comprising a plurality of the local dimming blocks; and a light source driver comprising a plurality of channels configured to output light source driving signals to the plurality of local dimming blocks based on the dimming signal, wherein each light source driving signal comprises a light source intensity value representing a light intensity of a local dimming block from among the plurality of local dimming blocks and a delay value representing a degree of a delay of the local dimming block, wherein the delay value is determined by a scan delay value varied according to the plurality of scan blocks and a delay parameter, and wherein the delay value of the light source driving signal corresponds to a distance between a falling edge of the light source driving signal applied to a first scan block and a falling edge of the light source driving signal applied to a present scan block.

14. The display apparatus of claim 13, wherein the display panel comprises a plurality of display blocks, the display blocks corresponding to the plurality of local dimming blocks.

15. The display apparatus of claim 14, wherein the display blocks correspond to the plurality of local dimming blocks one-to-one.

16. The display apparatus of claim 13, wherein the delay parameter corresponds to a count value of a horizontal synchronizing signal of the light source driving signal and a number of the plurality of scan blocks of the light source.

17. The display apparatus of claim 16, wherein the count value of the horizontal synchronizing signal of the light source driving signal represents a resolution of the light source intensity value.

18. The display apparatus of claim 17, wherein the delay parameter is an integer close to the count value of the horizontal synchronizing signal divided by the number of the plurality of scan blocks.

19. The display apparatus of claim 13, wherein the light source intensity value, the scan delay value and the delay parameter are stored in a register of the light source driver.

20. The display apparatus of claim 19, wherein when a number of the channels of the light source driver is N, a size of the register of the light source driver is 2N+2 bytes.

21. The display apparatus of claim 13, wherein the delay parameter is not varied according to the plurality of scan blocks.

* * * * *